US009133834B2

(12) United States Patent
Pini

(10) Patent No.: US 9,133,834 B2
(45) Date of Patent: Sep. 15, 2015

(54) HIGH PRESSURE PUMPS FOR INJECTING CEMENT MIXTURES

(71) Applicant: SOILMEC S.p.A., Cesena (Forlì Cesena) (IT)

(72) Inventor: Mauro Pini, Faenza (IT)

(73) Assignee: SOILMEC S.p.A., Cesena, Forli'-Cesena (IT)

( * ) Notice: Subject to any disclaimer, the term of this patent is extended or adjusted under 35 U.S.C. 154(b) by 391 days.

(21) Appl. No.: 13/671,571

(22) Filed: Nov. 8, 2012

(65) Prior Publication Data

US 2013/0115115 A1 May 9, 2013

(30) Foreign Application Priority Data

Nov. 8, 2011 (IT) ..... TO2011A1029

(51) Int. Cl.

| | |
|---|---|
| ***F04B 23/00*** | (2006.01) |
| ***F04B 15/02*** | (2006.01) |
| ***F04B 53/02*** | (2006.01) |
| ***F04B 53/08*** | (2006.01) |
| ***F04B 53/18*** | (2006.01) |

(52) U.S. Cl.

CPC ..... *F04B 23/00* (2013.01); *F04B 15/02* (2013.01); *F04B 53/02* (2013.01); *F04B 53/08* (2013.01); *F04B 53/18* (2013.01)

(58) Field of Classification Search

CPC ..... F04B 9/10; F04B 15/02; F04B 23/00; F04B 53/02; F04B 53/08; F04B 53/18

USPC ..... 60/456; 92/165 R

See application file for complete search history.

(56) References Cited

U.S. PATENT DOCUMENTS

| | | | | |
|---|---|---|---|---|
| 3,114,326 | A * | 12/1963 | Yaindl | 92/144 |
| 3,602,613 | A * | 8/1971 | Gunther et al. | 92/156 |
| 5,209,495 | A * | 5/1993 | Palmour | 277/500 |
| 6,158,313 | A | 12/2000 | Schlecht | |
| 6,834,862 | B2 * | 12/2004 | Wilkinson | 277/510 |
| 7,913,508 | B2 * | 3/2011 | Pu et al. | 417/313 |
| 2008/0193299 | A1 | 8/2008 | Oglesby | |

FOREIGN PATENT DOCUMENTS

| | | | |
|---|---|---|---|
| EP | 0078384 | A1 | 5/1983 |

* cited by examiner

*Primary Examiner* — Thomas E Lazo

(74) *Attorney, Agent, or Firm* — Robert E. Alderson, Jr.

(57) ABSTRACT

High pressure pumps for injecting cement mixtures are provided. Such pumps are configured so that the frequency and costs of servicing are greatly reduced.

14 Claims, 2 Drawing Sheets

HIGH PRESSURE PUMPS FOR INJECTING CEMENT MIXTURES

CROSS REFERENCE TO RELATED APPLICATION

This application claims priority to and benefit of Italian Patent Application No. TO2011A001029 filed Nov. 8, 2011 , the contents of which are incorporated by reference in their entirety.

FIELD OF THE INVENTION

The present invention relates to high pressure pumps (or jet pump) for injecting cement mixtures.

BACKGROUND OF THE INVENTION

The primary consolidating fluid used in such pumps is generally a binary fluid consisting of water and cement. This fluid is injected into a hole in the soil to be consolidated through a drilling rod string at the bottom of which there is fixed an injection head, called a "monitor", which has at its outlet at least one very small diameter nozzle capable of increasing the injection pressure to very high values. It is also a common practice to inject ternary fluids consisting of plastic mixtures of water, cement and bentonite, which are used to make a soil impermeable instead of increasing its mechanical characteristics. Sometimes it is possible to use a pumping system for injecting only one of the fluids described above (e.g. water), in order to treat the soil, to bring about hydraulic disaggregation or for other purposes known in the field. There is also a known practice of combining with the primary fluids particular additives to vary some of their characteristics (setting time, plasticity, consistency, strength etc.).

The range of pressures of such pumps runs from 50 to 1000 bars, while the flow rates vary from a few hundred liters per minute to more than 1000 liters per minute. The cement makes the mixture abrasive, with consequent wear problems for some components of the pump.

For a better understanding of the state of the art and of the problems relating thereto, a description first will be given of a high pressure pump of a known type for injecting cement mixtures (primary fluid), making reference to FIG. 3 in the attached drawings.

The pump makes use of three single-action suction and force plungers such as the one indicated by reference number 11. The plunger is sealingly supported and guided in its reciprocating motion by a sealing device 20, which includes a cylindrical sleeve 21 locked by means of a clamping ring 22 coaxially inside a flanged supporting bush 23. A closed circuit is formed in the sealing device for a second lubricating fluid (or secondary fluid), in particular lubricating oil, with two ducts, inlet 24 and outlet 25, formed in the inner sleeve and in the bush, and an axially extended annular chamber 26 formed in the internal cylindrical cavity 27 of the sleeve, around the plunger. At the two opposite sides of the lubrication chamber 26 a respective annular oil sealing gasket 28, 29 is provided, fixed to the cylindrical sleeve 21 and acting against the plunger. At the end of the sleeve on the "wet" side facing towards the pumping chamber, there is fitted in the internal cylindrical cavity a sealing gasket 32 sealing against the primary fluid, particularly cement; at the opposite end, on the dry side near the clamping ring 22, a scraper ring 33 is mounted.

Currently, gaskets sealing against cement have an average life of about 200-300 hours, depending on the type of cement and the operating conditions: pressure, flow rate and SPM (number of strikes per minute). There is no device capable of indicating wear on the seals. Failure of the cement gasket to seal causes contamination of the secondary fluid lubricating the plungers. The presence of cement in the lubricating oil indicates that the gaskets are no longer sealing; in these conditions, however, it becomes necessary to replace not only the gaskets but the oil itself, and often overloading problems are created for the pump, the filter and the other components in the circuit. In these conditions the sleeve of the sealing device, too, is subject to premature wear due to an increase in friction with the plunger (no longer guided by the worn gasket) and to the presence of cement in the lubricating oil. The oil must normally be replaced every 500 hours, and thus it would be particularly useful to have gaskets capable of working for at least the same amount of time in order to reduce the frequency and cost of servicing. In fact servicing procedures to replace seals are very complex and require the dismantling of many components. Such servicing can take several hours; if performed simultaneously with replacing the oil, there would be an enormous simplification of the servicing process and costs would be drastically reduced.

SUMMARY OF THE INVENTION

The present invention provides high pressure pump capable of achieving excellent results in terms of reliability and life of the wearing components, while optimizing servicing and reducing operating costs.

DETAILED DESCRIPTION

Figure 1:
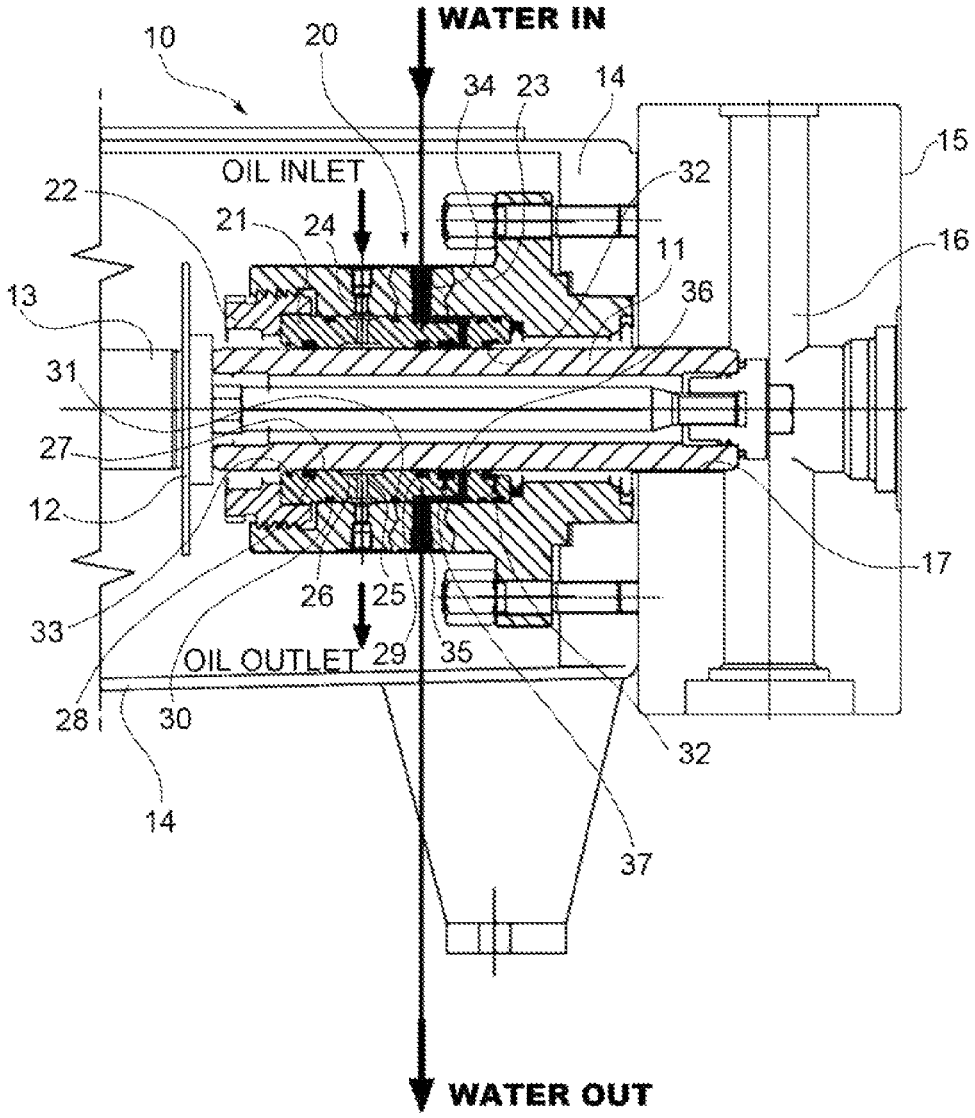
FIG. 1 provides a schematic partial cross-sectional view of an exemplary embodiment of a pump according to the present invention.

Referring to FIG. 1, numeral 10 generally designates a reciprocating pump with suction and force plungers, capable of working at high pressures for injecting concrete mixtures in order to increase mechanical or moisture-proofing characteristics of soils. The pump 10 in this embodiment is a reciprocating pump with several cylinders side by side in line, in each of which there runs a respective single-action suction and force plunger 11, only one of which is shown in the drawing. In particular, according to certain embodiments, the pump includes a system having three plungers, which define a so-called "Triplex pump". The plunger 11 connected, by a connection system 12 (here represented as a collar joint, but as a variant it also may be made using a tie-rod or similar component) to a rod 13 driven by a crankshaft (not shown), by a respective connecting rod (not shown). The body 14 of the pump may be integral with a block 15 in which there are formed pumping chambers 16, one for each plunger. The plunger may penetrate into the pumping chamber through an aperture 17. By using a system of valves, the pumping chamber 16 reduces its volume as a result of the entry of the plunger 11 resulting in an increase in the pressure of the primary fluid contained therein. When the required pressure is reached, the valve (not represented) opens an outlet and the pressurized fluid is injected into the pumping line until it reaches the drilling machine.

The pump described herein is not to be considered limited by the types of fluid with which it operates. In the remainder of the description and the annexed claims, the term "primary fluid" or "first fluid" refers to a fluid which is to be pressurized by the pump and injected into a soil. In many applications, the primary fluid will be a mixture containing cement (for example water and cement, or water, cement and bentonite). The expression "second fluid" or "secondary fluid" refers to a fluid which is used principally for lubricating the plungers (or the plunger) of the pump, according to procedures known per se. In certain embodiments, the second fluid includes lubricating oil. An important advantage of pumps according to certain embodiments of the present invention results from the presence of a third operating fluid, which is used to control the surfaces affected by the sliding of the plunger(s). This third cooling fluid can be, for example, water or an aqueous mixture or solution, suitable for the purposes set forth herein.

The plunger 11 is sealingly supported and guided, in its reciprocating motion in a direction here described as "longitudinal", by a sealing and guiding device designated overall by reference number 20. The sealing device 20 includes a cylindrical sleeve 21 locked by clamping ring 22 arranged coaxially within a flanged supporting bush 23. The bush 23 may be removably fastened to the body 14 of the pump.

A closed circuit for forced lubrication, for a second fluid, such as oil, is formed in the sealing device 20. The lubrication circuit may include two radial ducts formed in the inner sleeve and in the bush, specifically an oil inlet duct 24, an oil outlet duct 25, and an axially extended annular chamber 26 formed in the inner cylindrical cavity 27 of the sleeve, at the interface with the plunger. The inlet and outlet ducts for the secondary fluid may be inverted. On the two opposite sides of the lubrication chamber 26, two respective annular oil sealing gaskets 28, 29 may be arranged, fixed to the cylindrical sleeve 21 and acting against the plunger 11. The gasket 28 may be oriented with its principal sealing lip extending toward the "wet" side, while the sealing gasket 29 itself also may be oriented with its principal sealing lip towards the "wet" side. This orientation allows the seal from the lubrication chamber 26 not to be hermetic towards the "wet" side, thus allowing a slow and continuous controlled leakage of lubricating fluid which serves to moisten a sealing gasket 37, described hereinafter, thus keeping it lubricated. Two further O-ring gaskets 30, 31 may be interposed between the sleeve 21 and the supporting bush 23, with sealing functions against the secondary lubricating fluid.

At the end of the sleeve 21, on the "wet" side facing towards the pumping chamber for the primary fluid, there is fitted in the internal cylindrical cavity 27 a first sealing gasket 32 against the primary fluid (or "cement seal"); at the opposite end, on the dry side near the clamping ring 22, there may be fitted a conventional scraper ring 33.

A cooling circuit with a third fluid, such as water (or other liquid) is formed in the sealing device 20, with radial intake duct 34 and outlet duct 35 formed through the outer bush and the inner sleeve 21, and an annular chamber 36 formed in the internal cylindrical cavity 27 of the sleeve around the plunger 11. The intake and outlet ducts may be inverted with respect to what is shown, without altering the functionality of the system.

The annular chamber 36 is sealed toward the "wet" side by the first sealing gasket 32 sealing against cement, while on the opposite side, facing towards the clamping ring 22, the chamber 36 is sealed against the plunger 11 by a second guiding and sealing gasket 37 sealing against the primary fluid, particularly against cement mixtures. The second sealing gasket 37 may be axially interposed between the first sealing gasket 32 sealing against the first fluid and the annular chamber 26 of the lubrication circuit. As shown in the illustrated example, the second cement sealing gasket 37 is located adjacent to the oil sealing gasket 29. The sealing gaskets 28, 29, 32, 37 and the scraper 33 may be seated in respective annular grooves formed in the internal cylindrical cavity 27 of sleeve 21.

The second sealing gasket 37, in addition to sealing against the cooling water, also serves as a guide element for the plunger 11, and therefore its shape and the material from which it is made are chosen appropriately to resist high specific pressures. In a variant (not shown), the second sealing gasket 37 also may incorporate the functions of the sealing gasket 29 which therefore could be omitted. In this case the sealing gasket 37 directly delimits the annular chamber 26 of the second lubrication fluid, and also would perform sealing functions against the secondary fluid on the "wet" side as well as sealing the primary fluid and guiding the plunger piston 11.

As it reciprocates, the plunger 11 can move between an axially retracted position (to the left in FIG. 1) and an axially extended position (to the right) in which it enters deeper into the pumping chamber 16. In every position taken by the plunger 11 along its stroke, at least a part of its cylindrical outer surface is always seated within the inner cylindrical cavity 27 and faces both of the annular chambers 26 and 36.

Figure 2:
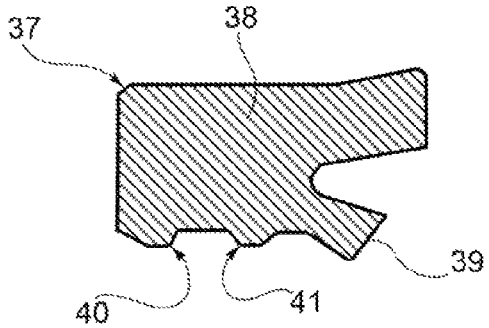
FIG. 2 provides an enlarged view of a section of a sealing gasket for the pump of FIG. 1.
Figure 3:
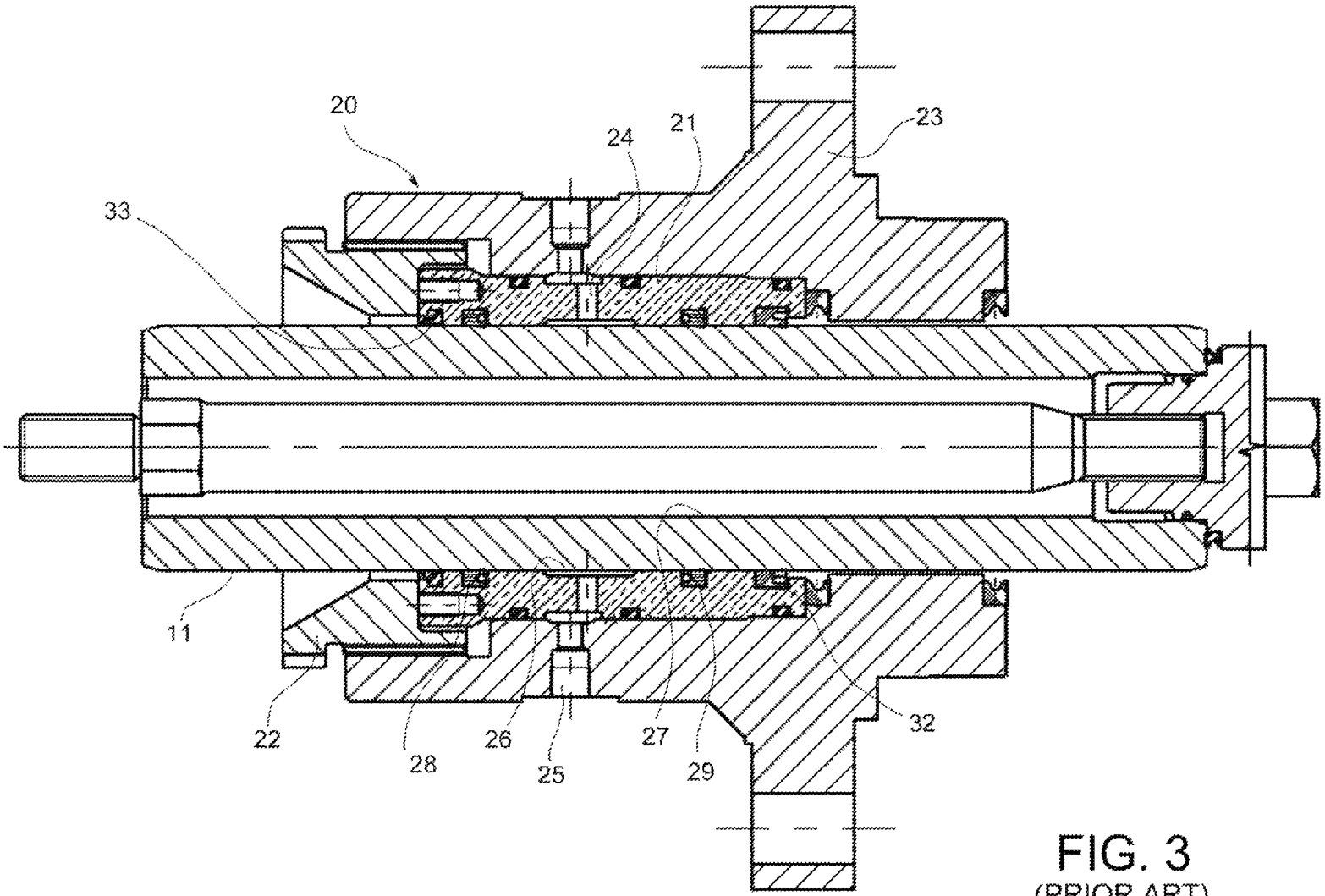
FIG. 3 (PRIOR ART)
FIG. 3 is a partial cross-sectional view of a pump of a known design.

In the embodiment shown, enlarged in FIG. 2, the sealing gasket 37 has an annular body 38 from which protrude internally several annular reliefs, in this example three in number, suitable for sliding against the plunger 11. A sealing lip 39, of a generally truncated-conical shape, may project obliquely toward the wet axial side of the pump and radially towards the plunger. Two annular reliefs 40, 41, axially spaced apart from one another, may project in radially internal directions, and each may terminate with a respective radially internal cylindrical surface suitable for guiding and stabilizing the plunger 11. The sealing lip 39 may be located closer to the pumping chamber 16, while the annular reliefs 40, 41 are farther from the pumping chamber.

The compartments or cavities formed between the annular reliefs 40, 41 and between the relief 41 and the lip 39, and open towards the plunger 11, allow lubricating fluid coming from the leakage of sealing gasket 29 to be appropriated. This occurs because of the compartment identified between the two contiguous reliefs on which the specific pressure, necessary for guiding, is very high, unlike that which is generated in the cavities which is very low and which will favor the accumulation of lubricating fluid. The accumulation of lubricant helps to increase the life of the sealing gasket 37. The alternation between full and empty also enables dispersal of the heat due to the friction between the internal cylindrical surface of the reliefs 40 and 41, the lip 39 and the outer surface of the plunger 11. In alternative embodiments (not shown), there may be only one of the two reliefs 40, 41, or, in a further embodiment, there may be more than two reliefs. In the embodiment shown in FIG. 2 in undeformed condition, the annular reliefs 40, 41 have an axial section of trapezoidal shape. The annular reliefs 40, 41 considerably reduce the radial loads and the friction on the first frontal sealing gasket 32, which originally serves to seal against cement. The plain cylindrical side on reliefs 40 and 41, rather than the normal apex which can be found on profiles with a triangular section, ensures that the plunger 11 is correctly guided. The cylindrical inner surface of reliefs 40, 41 may contain furrows or grooves suitable for allowing the passage of secondary fluid for lubricating at least one of the said reliefs and the sealing lip 39.

The second sealing gasket 37 also may function to provide a seal against cement. The third cooling fluid (water or other liquid) which circulates in the chamber 36 also serves to lubricate the second sealing gasket 37 and to further cool the plunger, by direct washing. This fluid therefore has two functions: the principal function of cooling the seals, the plunger and the sleeve, and the secondary function of lubricating sealing gaskets 32 and 37 which would not be reached by the secondary lubricating fluid. In fact the inner side, toward the "wet" part of sealing gasket 37 and the whole of sealing gasket 32, would not be in contact with the secondary lubricating fluid. For this purpose, as a third fluid, it is possible to use liquids enriched with additives to improve this second function, or oil (in this case, to offset a disadvantage caused by the contamination of a valuable fluid, which provides a further extension of the life of the sealing components and the other parts in relative movement and subject to the presence of abrasive fluids (such as cement mixtures). Any contamination of the third fluid by the cement indicates wear on the first, outermost sealing gasket 32. At the point when the first sealing gasket 32 deteriorates and loses its sealing function, it allows cement to pass which is diluted by the flow of water. In this case, however, unlike previously existing pumps, it is possible to determine that the water contains a second component, because the outlet allows the fluid to free-fall or fall into an open container, or to pass into a transparent tube close to the operator's station. While lubricating oil requires a closed and filtered circuit, the water can be directed and handled more freely because it does not represent an environmental pollutant. The second m sealing gasket 37, in the event of damage to the first sealing gasket 32 (which is in direct contact with the cement zone and is therefore the most subject to deterioration), allows the pump to maintain its functionality because, as a secondary function, it acts as a cement seal. In this way the cement is prevented from ending up in the oil lubrication system, which allows it to be isolated and better protected.

Furthermore, by inserting an overload sensor (not shown) in the washing line, downstream of the plunger, it is possible to detect the presence of cement in the cooling circuit, indicating that the first, outermost sealing gasket 32 is in a worn condition. This sensor will send a signal to a data processing unit (not shown), which, on processing the information, will display an alarm to the operator, on a control panel in a command area such as a warning light, an acoustic alarm or, if there is a monitor, a pop-up alarm with or without an audio signal.

The overload sensor may be of a pressure type (any inclusion of cement mixture inside the duct for the third fluid will increase the pressure necessary for the contaminated fluid to circulate).

Alternatively, optical sensors may be used, such as those which measure fluorescence in UV light. Such sensors are able to detect the presence of oil in water. They can therefore warn of a problem with the sealing of the system of lubrication with the secondary fluid. When the concentration of oil, coming from the leakage from sealing gasket 29, in the third fluid is too high, a problem may be indicated with sealing gasket 29. The combination of this sensor with the others described above can indicate either damage to sealing gasket 32 for the primary fluid and/or damage to sealing gasket 29 for the secondary fluid.

Finally, it is possible to set up a suitable filter on the collection line for the third fluid, this filter, too, being provided with an overload sensor, which can provide a warning when the concentration of contaminant has reached a threshold level.

It will be appreciated that a worn condition of the outer sealing gasket 32 is detectable from the presence of cement in the third cooling fluid (or liquid), and that the combination of the cooling circuit with the addition of the second sealing gasket 37 increases the life of the first outer sealing gasket 32, as it is possible to circumscribe an isolated volume which can contain cooling fluid and lubricant. Since the second sealing gasket 37 still protects the seal, the operator can decide whether to proceed immediately with replacement or to defer it, without risking damage to the plunger 11, the sleeve 21 or the lubrication circuit, or risking contaminating the lubricating oil.

The invention thus results in lower maintenance costs, prolongation of life for the components (especially for the final sealing gasket sealing against cement, and for the sleeve of the sealing device), and extended and predictable maintenance intervals. A single maintenance intervention for changing the lubricating oil and the gaskets is possible. The state of wear of the sealing gaskets sealing against cement can be monitored. The gaskets no longer must be replaced only at scheduled and preventive maintenance intervals but can always be replaced promptly as soon as they are found to be in a worn condition. If necessary, if the final cement sealing gasket is moderately worn, it is possible to continue working without risking the sleeve or contaminating the oil, thanks to the second cement sealing gasket. Operators in the drilling field will appreciate that the second sealing gasket makes it possible to complete not only the execution of the jet column in progress, but for example to complete all the columns for the day or to reach a weekend or other scheduled break set aside for ordinary and for extraordinary maintenance on site. Thus it is possible to schedule maintenance activities without delaying planned production. Finally, it is possible to keep the life and the efficiency of the secondary fluid seal monitored.

It should also be appreciated that the description above and the illustrated embodiments are exemplary of the present invention and should not to be taken in any way as a limitation of scope, applicability or arrangement of components of the invention. The drawings and description, however, will provide those skilled in the art with a convenient outline for the implementation of the invention, while it will remain understood that various changes may be made to the function and arrangement of the elements described in the exemplary embodiments, without departing from the scope of the invention. For example, the number of plungers may vary depending on particular needs, or the sealing gasket 32 also may have the same secondary function of guiding the piston and be conformed in the same manner as the sealing gasket 37.

The invention claimed is:

1. A high pressure pump for injecting a first fluid comprising:

at least one pumping chamber;

at least one suction and force plunger acting in the pumping chamber;

a sealing device for supporting and sealingly guiding the plunger in a reciprocating motion, the sealing device comprising a cylindrical sleeve with an internal cylindrical cavity in which the plunger slides, a lubricating circuit for a second fluid, the lubricating circuit comprising an annular chamber formed in the inner cylindrical cavity of the sleeve around the plunger; and a first sealing gasket providing sealing action against the first fluid, the first sealing gasket being mounted in the cylindrical cavity at a wet side end of the sleeve at a position axially interposed between the pumping chamber and the first annular chamber;

wherein the pump further comprises a second sealing gasket for guiding the plunger and sealing against the first fluid, the second sealing gasket being mounted in the cylindrical cavity at a position axially interposed between the first sealing gasket and the annular chamber of the lubrication circuit, wherein the second sealing gasket has an annular body from which at least one main annular relief protrudes in a radially inner direction for sliding against the plunger, and a cooling circuit fluid for a third fluid, the cooling circuit comprising a further annular chamber formed in the hollow cylindrical inner cavity of the sleeve around the plunger at a position axially interposed between the first and second gaskets sealing against the first fluid.

2. The pump of claim 1, wherein the annular relief ends with a radially inner cylindrical surface for guiding and stabilizing the plunger.

3. The pump of claim 2, wherein a sealing lip protrudes from the annular body, the sealing lip having a substantially truncated cone shape extending obliquely toward the axially wet side of the pump, so as to sealingly slide against the plunger.

4. The pump of claim 3, wherein the sealing lip is located in a position closer to the pumping chamber than the at least one annular relief.

5. The pump of claim 2, wherein the cylindrical surface of the inner relief contains grooves configured for allowing the passage of the second fluid to lubricate at least one of the said reliefs and the sealing lip.

6. The pump of claim 1, wherein the cooling circuit is associated with at least one sensor capable of detecting the presence of the first fluid in the third fluid.

7. The pump of claim 6, wherein the sensor capable of providing a signal indicative of the level of contamination in the first fluid and the pump are operatively associated with a data processing unit adapted for receiving the signal emitted by the sensor, detecting whether a predetermined admissible contamination threshold level has been reached, and generating an alarm signal when the threshold level is reached or exceeded.

8. The pump of claim 6, wherein the sensor comprises a pressure sensing device.

9. The pump of claim 6, wherein the sensor comprises an optical device.

10. The pump of claim 6, wherein the sensors are at least two in number, adapted for indicating contamination by cement or oil.

11. The pump of claim 1, wherein the annular reliefs are at least two in number, axially spaced from one another, and having between them at least one receptacle open toward the plunger.

12. The pump of claim 1, wherein the second gasket delimits the first annular chamber of the second fluid and is shaped so as to ensure sealing action against the second fluid.

13. A high pressure pump for injecting a first fluid comprising:

at least one pumping chamber;

at least one suction and force plunger acting in the pumping chamber;

a sealing device for supporting and sealingly guiding the plunger in a reciprocating motion, the sealing device comprising a cylindrical sleeve with an internal cylindrical cavity in which the plunger slides, a lubricating circuit for a second fluid, the lubricating circuit comprising an annular lubricating chamber formed in the inner cylindrical cavity of the sleeve around the plunger;

a first cement-sealing gasket providing sealing action against the first fluid, the first cement-sealing gasket being mounted in the cylindrical cavity at a wet side end of the sleeve at a position axially interposed between the pumping chamber and the first lubricating annular chamber;

first and second annular oil-sealing gaskets arranged at two opposite sides of the annular lubricating chamber, said first and second annular oil-sealing gaskets axially delimiting the annular lubricating chamber and acting against the plunger thereby providing a sealing action against the second fluid and, a second cement-sealing gasket for guiding the plunger and providing a sealing action against the first fluid, the second cement-sealing gasket being mounted in the cylindrical cavity at a position axially interposed between the first cement-sealing gasket and the second oil-sealing gasket which delimits the annular lubricating chamber of the lubrication circuit on the side closer to the pumping chamber, and a cooling circuit for a third fluid, the cooling circuit comprising a further annular chamber formed in the hollow cylindrical inner cavity of the sleeve around the plunger at a position axially interposed between the first and second cement-sealing gaskets which provide a sealing action against the first fluid.

14. The pump of claim 13, wherein the second oil-sealing gasket for the second fluid is located closer to the pumping chamber than the first oil-sealing gasket and has a sealing lip extending toward the wet side, the sealing lip being configured and arranged to allow a controlled leakage of the second fluid thereby lubricating the second cement-sealing gasket, from the side opposite the wet side.

* * * * *